United States Patent [19]

Caplan

[11] 4,218,211

[45] Aug. 19, 1980

[54] ENERGY RECOVERY SYSTEM

[75] Inventor: Stanley Z. Caplan, Laval, Canada

[73] Assignee: Caplan Energy Recovery Systems Limited, Laval, Canada

[21] Appl. No.: 5,935

[22] Filed: Jan. 19, 1979

Related U.S. Application Data

[63] Continuation-in-part of Ser. No. 863,720, Dec. 23, 1977, abandoned, which is a continuation-in-part of Ser. No. 731,525, Oct. 12, 1976, abandoned.

[51] Int. Cl.[2] ..... F24H 1/00; F28C 3/10

[52] U.S. Cl. ..... 432/219; 126/91 A; 432/209; 432/223

[58] Field of Search ..... 126/91 A; 432/209, 219, 432/222, 223

[56] References Cited

U.S. PATENT DOCUMENTS

| | | | |
|---|---|---|---|
| 2,041,930 | 5/1936 | Hovlis | 126/91 A |
| 2,200,731 | 5/1940 | Woodson | 126/91 A |
| 2,796,118 | 6/1957 | Parker et al. | 126/91 A |
| 2,972,474 | 2/1961 | Von Linde et al. | 126/91 A |
| 3,142,482 | 7/1964 | Kenan | 432/209 |
| 3,920,382 | 11/1975 | Hovis et al. | 432/209 |
| 4,047,881 | 9/1977 | Eschenauer | 126/91 A |

FOREIGN PATENT DOCUMENTS

| | | | |
|---|---|---|---|
| 316602 | 4/1934 | Italy | 432/201 |

*Primary Examiner*—John J. Camby

*Attorney, Agent, or Firm*—Swabey, Mitchell, Houle, Marcoux & Sher

[57] ABSTRACT

An air heater for use in association with a radiant heating tube, the air heater comprising a heat exchanger having a combustion air inlet and a heated combustion air outlet, and a heated gas inlet and a heated gas outlet. The heated combustion air outlet has a transfer pipe connected thereto, an opposite end of the transfer pipe adapted to be connected to an inlet end of a radiant heating tube, and the heated gas inlet to the heat exchanger adapted to be connected to a discharge end of said radiant heating tube. The transfer pipe extending from the heated air outlet of the heat exchanger to an entrance to a radiant heating tube has an air control damper means situated therein. The end of the transfer pipe adapted to be connected to an entrance to a radiant heating tube has a venturi portion therein, an oil nozzle means being situated at inlet of the venturi portion of the transfer pipe adjacent the intake end of said radiant heating tube. Oil supply means are connected to the oil nozzle means and igniter means are situated adjacent to and downstream of said oil nozzle means within the transfer pipe for igniting a mixture of atomized oil and combustion air.

4 Claims, 3 Drawing Figures

ENERGY RECOVERY SYSTEM

This application is a continuation-in-part of U.S. patent application Ser. No. 863,720, filed Dec. 23, 1977, now abandoned, which in turn was a continuation-in-part of application Ser. No. 731,525, filed Oct. 12, 1976, now abandoned.

BACKGROUND OF THE INVENTION

1. Field of the Invention

The present invention relates to an improved air heater for use in association with industrial heat treating furnaces, kilns, cracking units in refining processes or similar installations which utilize radiant heating tubes.

2. Description of the Prior Art

The use of radiant heating tubes in kilns, cracking units, and heat treating furnaces is already well-known, the radiant heating tubes conveying heated air through the heat treating furnace in order to increase the temperature of the furnace enclosure. The principle of operation of a radiant heating tube used for heating an industrial furnace is that the outer surface of the tube provides heat by radiation into a furnace chamber. In order to achieve this efficiently, it is necessary to provide a source of radiant heat inside the tube, whereby the tube is heated to incandescence. When combustible fuels are utilized, this requires that there be a flame of a long, luminous nature, within the radiant heating tube since the luminosity is the property by which energy is radiated more or less uniformly to the internal tube surface. Any other method in which a flame is not produced within the radiant heating tube, such as in the case when there is only hot gas in the tube, relies more on convective heat transfer from the outer surface of the radiant heating tube to the furnace chamber. However, convective heat transfer becomes increasingly inefficient in this application as temperatures rise above 1000° F. As a result, hot gas cannot be utilized in radiant heating tubes in applications where it is necessary to increase the temperature of a furnace enclosure above 1000° F.

U.S. Pat. No. 3,930,382 to Hovis et al is one example of a system in which hot gas, as opposed to a flame, is directed through the radiant heating tubes of a furnace. In particular, in the embodiment of FIG. 7 of the patent, Hovis et al rely on the circulation of hot combustion gases alone via a hot gas line into hot gas feed headers coupled to radiant heating tubes. However, hot gases alone in the radiant heating tubes will not result in the tubes being heated to incandescence fast enough. As a result, little radiant energy is transferred from the outer surface of the radiant heating tubes to the interior of the furnace enclosure, thus limiting the temperature to which the furnace enclosure can be increased.

U.S. Pat. No. 2,041,930 to Houlis relates to a baking oven fired by fuel, diesel oil, or gas. As in the case of the Hovis et al patent referred to above, Houlis does not teach the creating of a flame within a radiant heating tube, but rather discloses use of hot gases only entering an enlarged pipe member 17′, the latter being of greater diameter than the exit end of the fire box which is situated therein.

In known installations in which radiant heating tubes are heated to incandescence by means of a fire or flame therein, the fire or flame is created by utilizing propane or natural gas as the fuel source. However, the Applicant has found that there are two essential drawbacks with the known system in which propane or natural gas is utilized. Firstly, the use of propane or natural gas is an expensive source of energy in the known radiant heating tube systems as none of the gases dispersed from the exit end of the radiant heating tube, which are at approximately 1,200° F., are utilized in any manner insofar as heat content thereof is concerned. As well, there is a potential shortage of natural gas in North America which could render the future use of natural gas as a source of fuel prohibitive.

One of the reasons that natural gas or propane is utilized in existing radiant heating tubes for heat treating furnaces and cracking units despite the above drawbacks is that the use of oil fired directly into a radiant heating tube would result in carbonizing of the radiant heating tube due to soot or dirt formed as the flame within the tube contacts the inner surface of the same. Hot points caused by carbon deposits in the radiant heating tube could result in burning out of the tube, necessitating replacement thereof, which could be quite expensive in the case of stainless steel tubes. As a result, oil has not been successfully used to date as a source of fuel in smaller diameter radiant heating tube installations in which a flame is produced in the radiant heating tube without also utilizing substantial quantities of excess air to avoid carbonizing. However, the excess air used must be heated to the temperature of the radiant heating tube, necessitating an additional consumption of fuel to heat the excess air and excess air results in short flame which does not radiate as well.

U.S. Pat. No. 2,796,118 to Parker et al discloses an arrangement in which a burner for tube firing is connected directly to a radiant heating tube in such a manner that a flame is produced within a radiant heating tube. However, in the case of the Parker et al patent, combustion takes place within the radiant heating tube utilizing a flame retention nozzle situated therein. In order to prevent carbonizing of the radiant heating tube, Parker et al disclose the use of a flow of secondary air adjacent the walls of the radiant heating tube to prevent contact thereof by the flame within the tube. Accordingly, substantial quantities of excess air must be employed in order to guide the flame within the radiant heating tube. However, as noted above, the use of excess air necessitates the heating of the air to the temperature of the radiant heating tube, thus requiring the use of additional oil to effect the heating of the excess air. While this additional consumption of oil might have been acceptable twenty years ago, such is certainly not the case today in the United States and Canada where efforts are being made to minimize the consumption of oil and reduce costs to as great an extent as possible. Additionally, the use of the excess air passing through the radiant heating tube at high velocity requires the use of a high energy fan, necessitating a further consumption of energy in the case of the Parker et al arrangement.

Further, with the Parker et al arrangement, it is impossible to ensure complete combustion of the oil in radiant heating tubes, thus resulting in carbonization of the radiant heating tubes and possible burning out of the tubes. In particular, unburned particles of oil from the flame retention nozzle would fall directly onto the walls of the radiant heating tube resulting in such carbonization. Since even a minimum amount of carbon deposits forming hot points could result in burning out of the radiant heating tubes in a short period of time, the use of the Parker et al arrangement could present serious problems in use insofar as replacement of expensive stainless steel radiant heating tubes is concerned.

British Specification No. 1,412,810, granted to Borg-Warner Corporation, relates to a heat exchanger in which a flame is directed into a tube, the flame being produced preferably by a gas fired burner. As in the case of the Parker et al patent, this patent necessitates the use of excess air in order to create a swirling action of the products of combustion in the U-shaped tubular heat exchange element, thus requiring additional fuel to heat the excess air to the temperature of the tube. Additionally, the Borg-Warner Corporation patent limits the flame created to the combustion chamber, with the products of combustion flowing through the heat exchange tube. Accordingly, it is apparent that the same is not directed to use of oil to create a flame within a radiant heating tube without carbonizing of the latter.

SUMMARY OF THE INVENTION

In accordance with the present invention, there is provided an air heater for use in association with a radiant heating tube, the air heater comprising a heat exchanger having a combustion air inlet and a heated combustion air outlet, and a heated gas inlet and a heated gas outlet. The heated combustion air outlet has a transfer pipe connected thereto, an opposite end of the transfer pipe adapted to be connected to an inlet end of a radiant heating tube, and the heated gas inlet to the heat exchanger adapted to be connected to a discharge end of said radiant heating tube. The transfer pipe extending from the heated air outlet of the heat exchanger to an entrance to a radiant heating tube has an air control damper means situated therein. The end of the transfer pipe adapted to be connected to an entrance to a radiant heating tube has a venturi portion therein, an oil nozzle means being situated at the inlet of the venturi portion of the transfer pipe adjacent the intake end of said radiant heating tube. Oil supply means are connected to the oil nozzle means; and igniter means are situated adjacent to and downstream of said oil burner means within the transfer pipe for igniting a mixture of atomized oil and combustion air. The high pressure mechanical atomizing nozzle permit fine atomization of the oil within the radiant heating tube. The venturi portion is adapted to facilitate mixing of combustion air and atomized oil, the heated combustion air effecting complete vaporization of the atomized oil, thereby preventing oil drops from contacting the radiant heating tube which would otherwise create carbon deposits resulting in burning out of the radiant heating tube. The air control damper means provides a control of combustion air in the venturi portion. A flame is adapted to be generated within the radiant heating tube and extends at least along substantially an entire length thereof, the flame heating the radiant heating tube to incandescence.

BRIEF DESCRIPTION OF THE DRAWINGS

In drawings which illustrate embodiments of the present invention.

DESCRIPTION OF THE PREFERRED EMBODIMENTS

Figure 1:
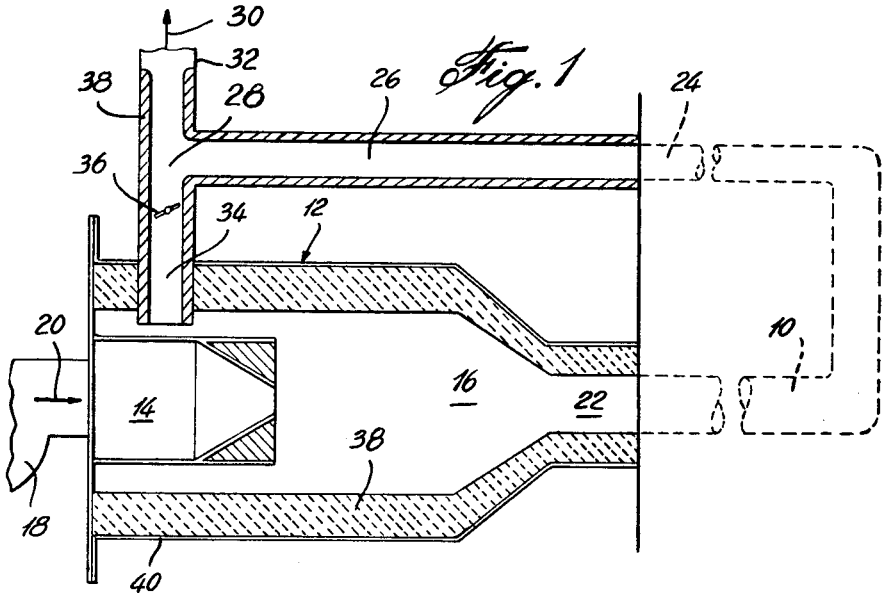
FIG. 1 is a vertical cross-section through one embodiment of an air heater according to the present invention, utilized in association with a respective radiant heating tube.

FIG. 1 illustrates an air heater system in which a radiant heating tube 10 has a respective burner associated therewith. For the sake of convenience, only one radiant heating tube with its respective burner unit 12 is illustrated in FIG. 1. Heater unit 12 includes a combustion chamber 14 situated within a larger mixing chamber 16. The burner 18 is mounted on the end of the unit and takes in fresh combustion air indicated by arrow 20 and creates combustion within the combustion chamber 14. The mixing chamber 16 converges into an outlet 22 which is connected to the inlet end of a radiant heating tube or tuyere 10. The outlet end 24 of the radiant heating tube 10 is connected to a discharge tube 26, the discharge tube having a T-connection at location 28 which splits the flow of heated air. A portion of the heated air is directed upwardly as indicated by arrow 30, into a stack 32 which discharges the air into the atmosphere. The remaining heated air in the discharge tube 26 is directed downwardly through tube 34, past damper 36, and into mixing chamber 16, wherein the returned heated air is mixed with hot combustion gases from the combustion chamber 14.

A high pressure burner 18 is utilized in order to draw heated air along the tube 34 and into the mixing chamber 16. However, rather than using a high pressure burner in order to draw heated air along the tube 34, a heat exchanger type of an arrangement can be provided whereby outside air is heated by the hot gases in the discharge tube 26 prior to being directed into the mixing chamber 16. As seen in FIG. 1, the mixing chamber 16, the discharge tube 26, and tube 34 are provided with a refractory lining 38. Further, the unit is manufactured from commercial steel lining 40.

Figure 2:
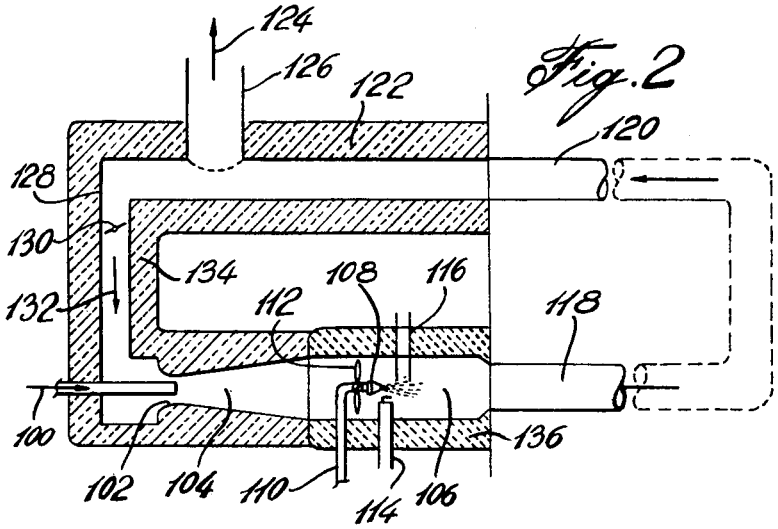
FIG. 2 is a diagrammatic representation of a further embodiment of a recirculating air heater used in association with a respective radiant heating tube.

In the embodiment of FIG. 2, combustion air indicated by arrow 100 is directed into a mouth or inlet end 102 of a venturi 104, the downstream exit end of the venturi merging into a combustion chamber 106. The combustion chamber has a nozzle 108 situated therein for supplying oil to the combustion chamber via an oil inlet pipe 110. The pipe 110 has a diffuser 112 mounted thereon adjacent the nozzle 108. Also situated within the combustion chamber is an igniter 114 comprising a pair of electrodes for igniting the oil mixture within the combustion chamber. Further a flame rod 116 is situated adjacent the location where the flame is produced within the combustion chamber in order to detect the presence of the flame within the chamber. The flame rod automatically controls the flow of oil through inlet pipe 110, such that the flame rod presents the accumulation of oil within the chamber should the flame be burnt out.

The discharge end of the combustion chamber 106 is connected to a radiant heating tube 118 which extends through the enclosure of a heat treating furnace, or similar unit. The discharge end 120 of the radiant heating tube 118 is connected to a discharge tube 122. The heated air in the discharge tube is divided so that a portion of the flow is directed upwardly, as indicated by arrow 124, into a stack 126. The remaining portion of the hot air flows through a return air tube 128 which is connected to the heater unit upstream of the venturi 104, the return air tube 128 having a damper 130 therein. The flow of heater air in the return air tube 128 is indicated by arrow 132, the heated air being drawn along the return air tube by the suction created due to the flow of combustion air through the venturi. After passing through the return air tube, the heated air flows through venturi 104 and into the combustion chamber 106. Control of the flow of heated air within the return air tube 128 is effected automatically by means of a control sensor connected to the damper 130, the control sensor sensing the temperature within combustion chamber 106.

Refractory lining 136 is provided in the combustion chamber 106, and insulation 134 is provided around the discharge tube 122 and the return air tube 128, as well as around the venturi 104.

Figure 3:
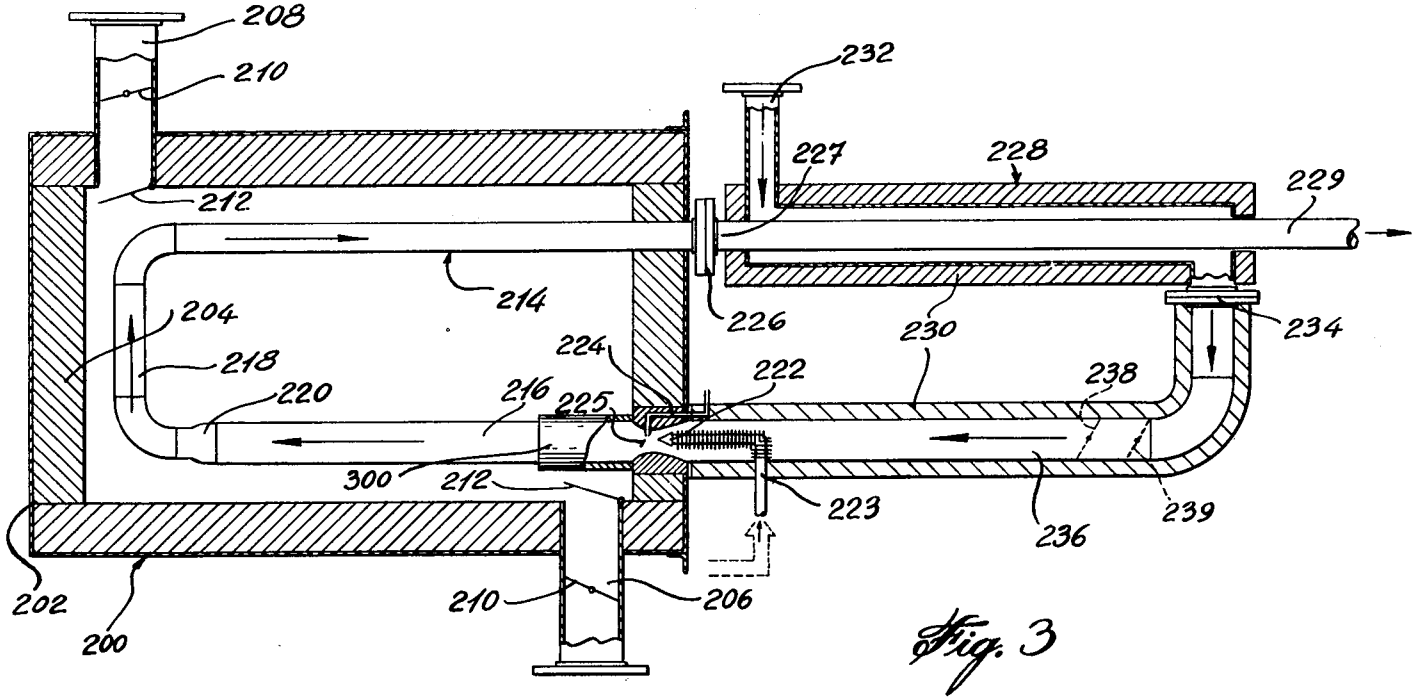
FIG. 3 is a third embodiment of a recirculating air heater, the burner being situated adjacent the entrance to the radiant heating tube.

In the embodiment according to FIG. 3, there is illustrated a sealed-down version of a furnace enclosure 200 comprising a mild steel shell 202 and is lined with five inch thick insulation 204, the insulation adapted to withstand a temperature of up to 2200° F. The furnace enclosure includes an inlet tube 206 and an outlet tube 208, the inlet and outlet tubes being provided with respective adjustable dampers 210 and respective fixed dampers 212, the fixed dampers being of 316 stainless steel construction. The adjustable dampers are pivoted by means of a shaft extending through the center thereof and the fixed dampers are pivoted at their ends to the inner ends of the respective intake and outlet tubes 206 and 208.

A U-shaped radiant heating tube 214 of 316 stainless steel construction throughout extends through the furnace enclosure 200, the radiant heating tube having a first section 216 and a second section 218 of lesser cross-sectional area than the first section. A reducer 220 connects the first section 216 to the second section 218, the reducer 220 providing a smooth transition between the two sections.

An oil burner 221 is mounted adjacent the entrance to the radiant heating tube, the oil burner 221 having a high pressure mechanical atomizing nozzle 222. An oil pipe 223 is connected to the nozzle 222, the oil pipe 223 being provided with fins in order to more effectively preheat the oil in the oil pipe before reaching the nozzle 222, thereby facilitating the atomization of the oil. The high pressure mechanical atomizing nozzle 222 ensures complete combustion of the oil when the mixture of atomized oil and combustion air is ignited by an igniter 224. Further, the high pressure mechanical atomizing nozzle, which is similar to that used in conventional fire box combustion chambers, prevents dripping of oil which would otherwise occur if a conventional nozzle were utilized, since the latter does not achieve sufficiently fine atomization of the oil in order to prevent the formation of carbon deposits resulting in hot points which could cause burning out of the radiant heating tube.

The nozzle 222 is situated within a venturi 225, a down-stream end of which merges into the entrance of the radiant heating tube 214. Since there is a minimum pressure drop through the venturi 225, a shaping of the flame within the radiant heating tube is created, thereby further ensuring that no oil drops will come into contact with the radiant heating tube.

The discharge end of the radiant heating tube is connected by means of a coupling 226, situated exterior to the furnace enclosure 200, to a hot gas inlet 227 of a heat exchanger 228, the heat exchanger 228 having a hot gas outlet 229 for removing the hot gases from the heat exchanger. The heat exchanger 228 permits heat transfer between combustion air entering the heat exchanger through an air inlet 232, the heated combustion air leaving the heat exchanger via an outlet 234. The outlet 234 of the heat exchanger is coupled by means of a transfer pipe 236 to the intake to the radiant heating tube 214. Both the heat exchanger 228 and the transfer pipe 236 are provided with respective layers of insulation 230 to limit heat transfer therefrom. Further, the transfer pipe 236 includes an automatic damper 238 for high-low fire in the radiant heating tube, the automatic damper 236 adjusting the flow of heated combustion air directed to the radiant heating tube, depending upon the firing rate. By means of the automatic air control damper 238, it is possible to maintain the temperature within precise limits. Thus, the automatic air control damper 238 only operates to either increase the flow of hot combustion air to the burner means when a specific low temperature within a desired temperature range is achieved, or to decrease the flow of hot combustion air to the burner means when a specific high temperature of the flame is achieved.

The transfer pipe 236 includes a second air control damper 239 situated in the transfer pipe upstream of the first damper 238, the second damper 239 allowing for a constant velocity of the combustion air in the venturi 225. The damper 239 is controlled automatically utilizing known control systems and plays an important part in the operation of the system when there is a cold start-up. In particular, when the system is initially operated, the temperature of the combustion air supplied to the nozzle is at a substantially lower temperature than the normal operating temperature of the combustion air supplied to the nozzle. As a result, and at this time, a greater volume of combustion air is supplied to the nozzle, and, accordingly, the air control damper 239 is in a substantially fully open position. As the temperature of the combustion air increases, the air control damper 239 closes in order to maintain the velocity of the air in the venturi 225 substantially constant. When the system is operative, it is conceivable that the same will operate with 5% excess air. Further, the treated combustion air, which may be up to 1000° F., effectively vaporizes the atomized oil discharged from the nozzle 222, thereby precluding the formation of carbonaceous products and permits complete combustion to take place.

Combustion takes place in the radiant heating tube and a flame extends throughout at least a substantial portion of the length thereof. By minimizing the use of excess air in the case of the present system, high temperatures can be achieved when utilizing oil as a supply of fuel, and as incandescence of the radiant heating tube occurs at temperatures in excess of 1650° F., excellent radiant heat transfer therefrom is achieved. On the other hand, on existing propane and natural gas fired radiant heating tube burners, the flame is adjusted to a certain length to minimize losses at the outlet due to the absence of a heat recovery system. With the oil burner means according to the present invention, radiant heat throughout the entire length of the radiant heating tube can be achieved due to the ability of the present system to recapture unused heat through the use of the heat exchanger 228. Accordingly, by utilizing the present invention, an existing furnace unit can be operated more efficiently with oil than with gas.

Further, the present invention permits the firing of a flame into a radiant heating tube of relatively small diameter without burning out of the tube due to carbon deposits being formed therein. Accordingly, it is anticipated that the present invention could be utilized in association with a radiant heating tube having an intake diameter of 3 inches, there being no limitation on the upper limit of the size for the radiant heating tube in association with which the present invention could be utilized.

Because of the high temperatures created at the firing tube caused by the recovery heat of approximately a 1,000° F., and the normal oil firing temperature of approximately 2,500° to 2,600° F., and it has been found necessary to install a ceramic sleeve, shown at 300 in FIG. 3, in the first 12 to 18 inches of the firing tube 216 to avoid burning out of the tube.

Because of excessive latent heat in firing tube 216 the ignition assembly and the nozzle include means for retracting the nozzle which means effectively upon termination of firing, removes them from their location at the onset of the firing leg to place them in a position as shown in dotted lines in FIG. 3. The means then returns them to their proper position when the thermal couples again call for more heat in the oven.

I claim:

1. An air heater for use in association with a radiant heating tube, the recirculating air heater comprising:

a heat exchanger having a combustion air inlet and a heated combustion air outlet, and a heated gas inlet and a heated gas outlet;

the heated combustion air outlet having a transfer pipe connected thereto, an opposite end of the transfer pipe adapted to be connected to an inlet end of a radiant heating tube, and the heated gas inlet to the heat exchanger adapted to be connected to a discharge end of said radiant heating tube;

the transfer pipe extending from the heated gas outlet of the heat exchanger to an entrance to a radiant heating tube having an air control damper means situated therein;

an end of the transfer pipe adapted to be connected to an entrance to a radiant heating tube having a venturi portion therein, an oil nozzle means being situated within the venturi portion of the transfer pipe adjacent the intake end of said radiant heating tube;

oil supply means being connected to the oil nozzle means; and igniter means situated adjacent to and downstream of said oil nozzle means within the transfer pipe for igniting a mixture of atomized oil and combustion air, the oil burner high pressure mechanical atomizing nozzle permit fine atomization of the oil within the radiant heating tube;

the venturi portion adapted to facilitate mixing of combustion air and atomized oil, the heated combustion air effecting complete vaporization of the atomized oil, thereby preventing oil drops from contacting walls of the radiant heating tube which would otherwise create carbon deposits resulting in burning out of the radiant heating tube;

the air control damper means providing a control of combustion air in the venturi portion;

a flame adapted to be generated within the radiant heating tube, the flame heating the radiant heating tube to incandescence.

2. An air heater according to claim 1, wherein the oil supply means comprises a finned oil pipe portion within the transfer pipe and upstream of the high pressure mechanical atomizing nozzle, the finned oil pipe portion adapted to increase the temperature of oil being supplied to the nozzle in order to facilitate complete atomization of the oil.

3. An air heater according to claim 1, wherein an end of the transfer pipe is adapted to be connected to an intake end of a radiant heating tube having a diameter of at least 3 inches.

4. An improved air heating system comprising:

a furnace enclosure having a radiant heating tube mounted therein;

an air heater connected between an intake end and an outlet end of the radiant heating tube, the air heater comprising:

a heat exchanger having a combustion air inlet and a heated combustion air outlet, and a heated gas inlet and a heated gas outlet;

the heated combustion air outlet having a transfer pipe connected thereto, an opposite end of the transfer pipe adapted to be connected to the intake end of a radiant heating tube, and the heated gas inlet to the heat exchanger adapted to be connected to the outlet end of said radiant heating tube;

the transfer pipe extending from the heated gas outlet of the heat exchanger to the inlet to the radiant heating tube having an control damper means situated therein;

an end of the transfer pipe adapted to be connected to the inlet to a radiant heating tube having a venturi portion therein, an oil nozzle means being situated within the venturi portion of the transfer pipe adjacent the intake end of said radiant heating tube;

oil supply means being connected to the oil nozzle means; and igniter means situated adjacent to and downstream of said oil nozzle means within the transfer pipe for igniting a mixture of atomized oil and combustion air, the high pressure mechanical atomizing nozzle to permit fine atomization of the oil within the radiant heating tube;

the venturi portion adapted to facilitate mixing of combustion air and atomized oil, the heated combustion air effecting complete vaporization of the atomized oil, thereby preventing oil drops from contacting walls of the radiant heating tube which would otherwise create carbon deposits resulting in burning out of the radiant heating tube;

the air control damper means providing a control of combustion air in the venturi portion;

a flame adapted to be generated within the radiant heating tube, the flame heating the radiant heating tube to incandescence.

* * * * *

UNITED STATES PATENT AND TRADEMARK OFFICE

CERTIFICATE OF CORRECTION

PATENT NO. : 4,218,211

DATED : August 19, 1980

INVENTOR(S) : Caplan

It is certified that error appears in the above–identified patent and that said Letters Patent are hereby corrected as shown below:

On the title page, item (21) should appear as shown below:

-- [21] Appl. No.: 4,935 --.

Signed and Sealed this

*Twenty-eighth* Day of *October 1980*

[SEAL]

*Attest:*

SIDNEY A. DIAMOND

*Attesting Officer*

*Commissioner of Patents and Trademarks*